US007579997B2

(12) United States Patent
Navarro et al.

(10) Patent No.: US 7,579,997 B2
(45) Date of Patent: Aug. 25, 2009

(54) ADVANCED ANTENNA INTEGRATED PRINTED WIRING BOARD WITH METALLIC WAVEGUIDE PLATE

(75) Inventors: Julio A. Navarro, Kent, WA (US); Richard N. Bostwick, North Bend, WA (US); Mark T. Chisa, E. Spanaway, WA (US); Omer C. Helfer, Black Diamond, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/866,556

(22) Filed: Oct. 3, 2007

(65) Prior Publication Data

US 2009/0091506 A1 Apr. 9, 2009

(51) Int. Cl.
*H01Q 13/00* (2006.01)

(52) U.S. Cl. ..... 343/776; 343/700 MS; 343/786

(58) Field of Classification Search ..... 343/700 MS, 343/772, 776, 786
See application file for complete search history.

(56) References Cited

U.S. PATENT DOCUMENTS

| | | | | |
|---|---|---|---|---|
| 3,573,835 A | | 4/1971 | Stark et al. | |
| 3,942,138 A | | 3/1976 | Schaedla | |
| 4,626,865 A | * | 12/1986 | Rammos | 343/786 |
| 4,959,658 A | * | 9/1990 | Collins | 343/786 |
| 6,061,026 A | * | 5/2000 | Ochi et al. | 343/700 MS |
| 6,670,930 B2 | * | 12/2003 | Navarro | 343/776 |
| 2004/0150554 A1 | | 8/2004 | Stenger et al. | |
| 2007/0139287 A1 | * | 6/2007 | Inomata et al. | 343/786 |

FOREIGN PATENT DOCUMENTS

| | | |
|---|---|---|
| EP | 1 274 149 A2 | 1/2003 |
| EP | 1 274 149 A3 | 2/2003 |
| EP | 0 920 071 A2 | 12/2003 |
| EP | 0 920 071 A3 | 12/2003 |
| WO | WO 02/16889 A1 | 2/2002 |
| WO | WO 03/078936 A1 | 9/2003 |

OTHER PUBLICATIONS

International Search Report for International Application No. PCT/US2008/074473 dated Nov. 25, 2008, 16 pages.

* cited by examiner

*Primary Examiner*—HoangAnh T Le
(74) *Attorney, Agent, or Firm*—Rozenblat IP LLC

(57) ABSTRACT

A system and method of constructing a phased array antenna system that incorporates a printed wiring board assembly with a metallic waveguide plate is provided. The system uses a metallic waveguide plate to dissipate heat toward and through the waveguide portion of the system.

17 Claims, 2 Drawing Sheets

ADVANCED ANTENNA INTEGRATED PRINTED WIRING BOARD WITH METALLIC WAVEGUIDE PLATE

FIELD OF THE INVENTION

The present invention relates generally to phased array antennas, and more particularly to antenna-integrated printing wiring board assemblies for phased array antenna systems and methods of constructing such systems.

BACKGROUND OF THE INVENTION

Existing phased array antenna systems that incorporate antenna-integrated printed wiring board assemblies, such as those described in U.S. Pat. No. 6,670,930, utilize single or multi-layer printed wiring boards throughout the waveguide portion of the system. The printed wiring boards used in such systems are generally constructed of dielectric material that insulate heat. Heat generated by electronics integrated in the printed wiring boards does not easily dissipate through the waveguide portion and can degrade the performance of the system. For example, excess heat can cause lower Effective Isotropic Radiated Power (EIRP), higher noise, and limit the power level per unit cell. In addition, existing systems which utilize a cage-like conductive structure for the antenna element, also know as the "can," have a limited upper frequency of operation. It is desirable to provide a phased array antenna system which incorporates multi-layered printed wiring board assemblies that can operate at a higher upper frequency and more effectively dissipate heat through the waveguide portion, which can thereby allow, for example, an increase in power level per unit cell and better performance of the system.

SUMMARY

A system and method of constructing a phased array antenna system that incorporates a metallic waveguide plate and multi-layer printed wiring board is provided. A multi-layer printed wiring board assembly is provided with at least one probe and an at least one electronic device integrated therein. A metallic waveguide plate, with at least one waveguide formed therein, is positioned adjacent to the multi-layer printed wiring board assembly such that heat generated by the at least one electronic device dissipates to the metallic waveguide plate.

In some embodiments, the metallic waveguide plate is positioned such that at least a portion of the probe is contained within the waveguide. The waveguide may contain a dielectric material that surrounds at least a portion of the probe within the waveguide and provides a dielectric barrier between the probe and the metallic waveguide plate. The waveguide and the probe may thereby form an antenna element. The waveguide may be cylindrical and may include an upper portion and a lower portion, where the upper portion is of a greater diameter than the lower portion. The upper portion depth and diameter of the waveguide may correspond to a desired operating frequency. In addition, in another example embodiment, a metallic pedestal may be integrated into the printed wiring board and positioned adjacent to the metallic waveguide plate so that heat generated by the at least one electronic device dissipates to the metallic waveguide plate through the metallic pedestal. The metallic waveguide plate may be constructed of copper by casting and the walls of the waveguide may be contiguous. The features, functions, and advantages that have been discussed can be achieved independently in various embodiments of the preset invention or may be combined in yet other embodiments further details of which can be seen with reference to the following description and drawings.

DETAILED DESCRIPTION

A system and method of constructing a phased array antenna system that incorporates a printed wiring board assembly with a metallic waveguide plate is provided. The system uses a metallic waveguide plate to dissipate heat toward and through the waveguide portion of the system. The use of the metallic waveguide plate in conjunction with a printed wiring board assembly provides advantages which include but are not limited to: higher EIRP, lower noise, higher power level per unit cell, and larger range of operating frequency.

Figure 1:
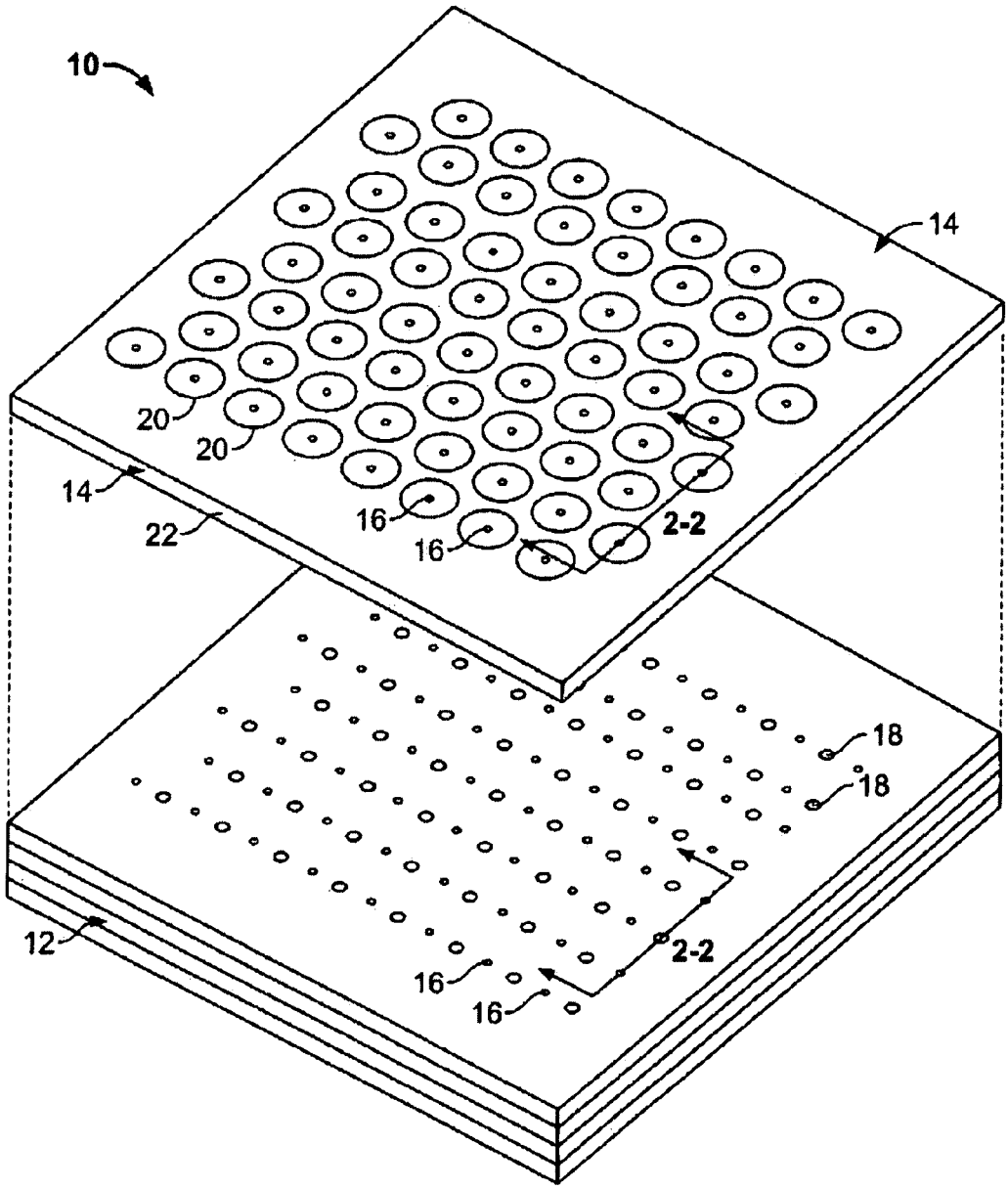
FIG. 1 is a top exploded perspective view of an example of one embodiment of a metallic waveguide plate and a printed wiring board assembly forming a sixty-four element phased array antenna system.

Referring to FIG. 1, the phased array antenna system 10 incorporates a multi-layer printed wiring board assembly 12 and a metallic waveguide plate 14. The multi-layer printed wiring board assembly 12 includes a plurality of independent layers or printed wiring board with interconnected circuitry, as described in U.S. Pat. No. 6,670,930, which is hereby incorporated by reference. For example, multi-layer printed wiring board assembly 12 may include electronic devices and power, logic, and RF distribution circuitry integrated therein. Such electronic devices can include but are not limited to, monolithic microwave integrated circuits (MMICs), application specific integrated circuits (ASICs), capacitors, resistors, etc. Accordingly, it is appreciated by those skilled in the art that multiple electrical and mechanical operations, such as RF, power, and logic distribution, are performed within and on multi-layer printed wiring board assembly 12. The multiple electrical and mechanical operations generate heat which must be dissipated to maintain effective performance of the system. In phased array antenna systems that incorporate waveguide portions constructed of printed wiring boards, such as those described in U.S. Pat. No. 6,670,930, heat is not easily dissipated toward and through such waveguide portions.

Figure 2:
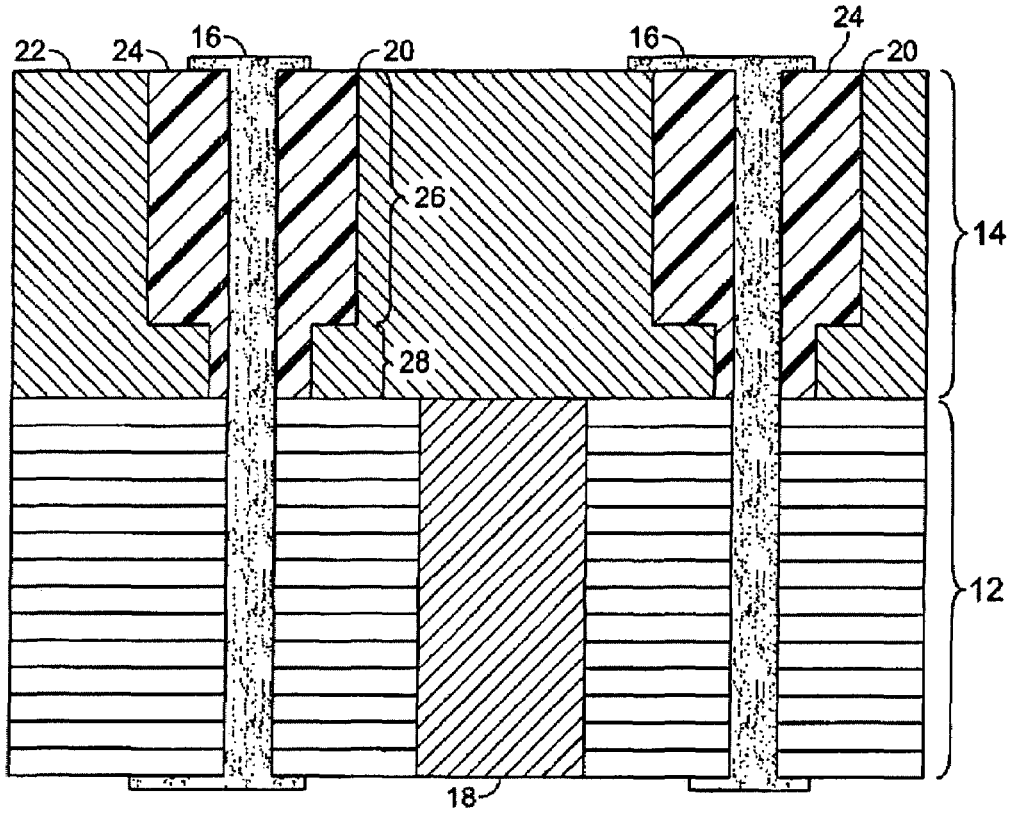
FIG. 2 depicts a cross sectional side view of an example of one embodiment of a metallic waveguide plate and a printed wiring board along lines 2-2 of FIG. 1.

With further reference to FIG. 1 and with reference to FIG. 2, multi-layer printed wiring board assembly 12 has radio frequency (RF) probes 16 integrated therein. The embodiment depicted in FIG. 1 includes sixty-four RF probes 16 arranged in an 8×8 grid. The number of RF probes 16 will vary according to the application. Metallic waveguide plate 14 has cylindrical holes formed therein which thereby form cylindrical waveguides 20. Cylindrical waveguides 20 can include upper portion 26 and lower portion 28. Upper portion 26 can be of a greater diameter than lower portion 28. Cylindrical waveguides 20 need not be cylindrical in shape and can be of various shapes, including but not limited to square, triangular, rectangular, hexahedral, and octahedral. The embodiment depicted in FIG. 1 also includes sixty-four cylindrical waveguides 20 arranged in an 8×8 grid to overlay the 8×8 grid of RE probes 16. Metallic waveguide plate 14 is positioned so that each RF probe 16 is within a corresponding cylindrical waveguide 20. Each RF probe 16 and corresponding cylindrical waveguide 20 form an antenna element. The frequency at which the antenna element will operate is determined by the diameter and depth of upper portion 26 of cylindrical waveguide 20. The diameter and depth of upper portion 26 may be, for example, one-half a guided wavelength and one-quarter a guided wavelength respectively. A deeper upper portion 26 will correspond to a lower operating frequency, while a more shallow upper portion 26 will correspond to a higher operating frequency, thereby allowing the system to operate at many different frequencies. Similarly, a wider diameter of upper portion 26 will correspond to a lower operating frequency while a more narrow diameter will correspond to a higher operating frequency. Each cylindrical waveguide 20 may be filled with dielectric material 24 to surround RF probe 16 and provide a dielectric barrier between metallic plate 22 and RF probe 16. Metallic pedestals 18 can be integrated with multi-layer printed wiring board assembly 12 to dissipate heat toward metallic waveguide plate 14.

In one embodiment, metallic plate 22 can be solid, thereby allowing the walls of cylindrical waveguide 20 formed therein to be contiguous. Contiguous walls of cylindrical waveguide 20 allows for a greater upper limit operating frequency than existing waveguide structures constructed with non-contiguous, or "cage-like," walls within multi-layer printed wiring boards, such as those described in U.S. Pat. No. 6,670,930.

Multi-layer printed wiring board assembly 12 can be constructed in accordance with the methods disclosed in U.S. Pat. No. 6,670,930. Metallic waveguide plate 14 and RF probes 16 can be constructed of, for example, copper. Metallic waveguide plate 14 with cylindrical waveguides 20 disposed therein can be constructed by, for example, casting or machining. Dielectric material 24 can be inserted into cylindrical waveguides 20 by, for example, injection molding or as prefabricated plugs. RF probes 16 can be constructed by, for example, drilling channels and plating through dielectric filled cylindrical waveguides 20. The copper plating can then be etched to shape the top and bottom portion of the RF probe 16. RF probes 16 can also be constructed by drilling a plating through both metallic waveguide plate 14 and multi-layered printed wiring board assembly 12 which are already secured to each other, as shown in FIG. 2. RF probes 16 can also be prefabricated an inserted into channels drilled to accommodate the probes. Referring to FIG. 2, multi-layer printed wiring board assembly 12 and metallic waveguide plate 14 are shown in close, abutting contact. Conventional fasteners, glue, solder, or laminate can be used to secure multi-layer printed wiring board assembly 12 and waveguide plate 14 in close, secure abutting contact.

The foregoing description of the preferred embodiments of the invention have been presented for purposes of illustration and description, and are not intended to be exhaustive or to limit the invention the precise forms disclosed. The descriptions were selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A phased array antenna system, comprising:

a multi-layer printed wiring board assembly;

at least one probe integrated with the multi-layer printed wiring board assembly;

at least one electronic device integrated with the multi-layer printed wiring board assembly;

a metallic waveguide plate positioned adjacent to the multi-layer printed wiring board assembly such that heat generated by the at least one electronic device dissipates to the metallic waveguide plate; and at least one waveguide formed within the metallic waveguide plate, wherein at least a portion of the at least one probe is disposed within the at least one waveguide of the metallic waveguide plate; and dielectric material filling the at least one waveguide around the entire portion of the at least one probe disposed within the at least one waveguide of the metallic waveguide plate, wherein the dielectric material forms a dielectric barrier between the at least one probe and the metallic waveguide plate.

2. The system of claim 1 wherein the at least one waveguide and the at least one probe form an antenna element.

3. The system of claim 2 wherein the at least one waveguide is cylindrical and further comprises an upper portion and a lower portion, wherein the upper portion is of a greater diameter than the lower portion.

4. The system of claim 3 wherein the upper portion depth and diameter of the at least one waveguide corresponds to a desired operating frequency of the antenna element.

5. The system of claim 1 further comprising:

a metallic pedestal integrated into the printed wiring board and positioned adjacent to the metallic waveguide plate such that heat generated by the at least one electronic device dissipates to the metallic waveguide plate through the metallic pedestal.

6. The system of claim 1 wherein the metallic waveguide plate is constructed of copper.

7. The system of claim 1 wherein walls of the at least one waveguide are contiguous.

8. A method of constructing a phased array antenna system, comprising:

forming at least one waveguide within a metallic waveguide plate;

positioning the metallic waveguide plate adjacent to a multi-layer printed wiring board assembly, wherein the multi-layer printed wiring board assembly has at least one electronic device integrated therein;

filling the at least one waveguide within the metallic waveguide plate with dielectric material;

drilling at least one channel through the dielectric material filling the at least one waveguide within the metallic waveguide plate;

disposing at least one probe into the at least one channel so that the at least one waveguide within the metallic waveguide plate is filled with the at least one probe and the dielectric material surrounding the at least one probe to form a dielectric barrier between the at least one probe and the metallic waveguide plate; and dissipating heat from the at least one electronic device through the metallic waveguide plate.

9. The method of claim 8 further comprising forming an upper portion and a lower portion in the at least one waveguide, wherein walls of the upper portion and lower portion are contiguous.

10. The method of claim 9 further comprising forming the upper portion depth and diameter to correspond to a desired operating frequency.

11. The method of claim 8 wherein the step of filling the at least one waveguide within the metallic waveguide plate with dielectric material is accomplished by injection molding.

12. The method of claim 8 wherein the step of disposing the at least one probe into the at least one channel further comprises integrating the at least one probe with the multi-layer printed wiring board assembly.

13. The method of claim 12 wherein the step of disposing the at least one probe into the at least one channel is accomplished by plating.

14. The method of claim 12 wherein the step of disposing the at least one probe into the at least one channel is accomplished by inserting at least one prefabricated probe into the at least one channel.

15. The method of claim 8 wherein the multi-layer printed wiring board assembly has at least one metallic pedestal integrated therein, and the step of dissipating heat from the at least one electronic device through the metallic waveguide plate is done by dissipating heat through the metallic pedestal to and through the metallic waveguide plate.

16. The method of claim 8 wherein the metallic waveguide plate is formed by casting.

17. The method of claim 8 further comprising the step of securing the metallic waveguide plate to be in abutting contact with the multi-layer printed wiring board assembly by at least one of fastening, gluing, soldering, and laminating.

* * * * *